US006267536B1

(12) United States Patent
Adachi et al.

(10) Patent No.: US 6,267,536 B1
(45) Date of Patent: Jul. 31, 2001

(54) SEALING ARRANGEMENT FOR TUNNEL SEGMENTS

(75) Inventors: Junn Adachi; Siegfried Glang, both of Hamburg; Dieter Kassel, Ronnenberg, all of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/423,323

(22) PCT Filed: Jun. 13, 1998

(86) PCT No.: PCT/DE98/01604

§ 371 Date: Nov. 4, 1999

§ 102(e) Date: Nov. 4, 1999

(87) PCT Pub. No.: WO99/02820

PCT Pub. Date: Jan. 21, 1999

(30) Foreign Application Priority Data

Jul. 8, 1997 (DE) ..... 197 29 019

(51) Int. Cl.[7] ..... E21D 11/38

(52) U.S. Cl. ..... 405/152; 405/135; 277/645

(58) Field of Search ..... 405/152, 135, 405/153, 151, 150.1, 147, 146, 137, 132; 177/645, 644, 614, 605, 648, 338, 626

(56) References Cited

U.S. PATENT DOCUMENTS

| | | | | |
|---|---|---|---|---|
| 4,762,441 | * | 8/1988 | Glang | 405/152 |
| 4,797,032 | * | 1/1989 | Glang | 405/152 |
| 4,900,607 | | 2/1990 | Glang et al. . | |
| 4,946,309 | | 8/1990 | Glang . | |
| 5,044,823 | * | 9/1991 | Burgess | 405/152 |
| 6,129,485 | * | 10/2000 | Grabe et al. | 405/152 |

FOREIGN PATENT DOCUMENTS

| | | |
|---|---|---|
| 43 01 981 | 7/1993 | (DE) . |
| 196 03 188 | 8/1996 | (DE) . |
| 0 306 581 | 3/1989 | (EP) . |
| 0 441 250 | 8/1991 | (EP) . |
| 0 522 912 | 1/1993 | (EP) . |
| 0 741 231 | 11/1996 | (EP) . |
| WO96/27073 | 9/1996 | (WO) . |

* cited by examiner

*Primary Examiner*—Eileen D. Lillis
*Assistant Examiner*—Frederick L. Lagman
(74) *Attorney, Agent, or Firm*—Collard & Roe, P.C.

(57) ABSTRACT

A sealing arrangement (1) has two abutting construction elements made of concrete, steel, reinforced concrete, cast iron or other materials, as well as a sealing section made of an elastomer material which sealingly bridges the gap between the two construction elements. The construction elements are in particular segments (2, 2") which are assembled into a tubular tunnel with transverse and longitudinal joints (3). Each segment is preferably provided with a continuous groove on all its abutting sides. An elongated sealing profile (5) is located in each groove, forming a sealing frame with frame corners. The sealing section has elongated open and/or closed flutes arranged on the section base side and elongated ducts arranged between the flutes and the section front side. The sealing section (5) also has at least two groups (A, B) of ducts of which the first (A) is located directly above the flutes while the other (B) is laterally offset with respect to the flutes. Both groups (A, B) of ducts lie substantially in a plane parallel to the base or front side of the section.

6 Claims, 4 Drawing Sheets

SEALING ARRANGEMENT FOR TUNNEL SEGMENTS

BACKGROUND OF THE INVENTION

1. Field of the Invention

The invention relates to a sealing arrangement consisting of two abutting construction elements made of concrete, steel, reinforced concrete, cast iron or other materials (for example synthetic resins), as well as of a sealing section made of an elastomer material which sealingly bridges the gap between the two construction elements, whereby the construction elements are in particular segments which are assembled into a tubular tunnel, with formation of transverse and longitudinal joints, whereby each segment is preferably provided with at least one groove extending all around and covering all abutting sides of the segments, and whereby a sealing section extending in the form of a strand is present in each groove, said sealing section being provided with open and/or closed flutes extending in the form of a strand and being arranged on the section base side, as well as with ducts also extending in the form of a strand and arranged between the flutes and the section front side. Since the segments have four abutting sides in most cases, the sealing frame consists of four assembled sealing sections, whereby the corners of the frame are preferably produced according to the injection molding process.

2. The Prior Art

A sealing arrangement according to the type specified above is known, for example from U.S. Pat. No. 4,946,309. As a result of the fact that the abutting construction elements or segments are compressed, with reduction of the spacing of the gap or the transverse and longitudinal joints, the sealing section made of elastomeric material then develops its sealing power through the interaction between force and reactive force. Such compression seals have been successfully used in numerous tunnel projects.

Now, based on the prior art described above, the problem is to arrange the flutes and ducts in such a way that the force-displacement performance of the parallel basic surfaces is assured for achieving permanent tightness.

SUMMARY OF THE INVENTION

Said problem is solved in that the sealing section has at least two groups of ducts, whereby the one group of ducts is located directly (i.e. without displacement) above the flutes, whereas the other group of ducts is arranged displaced sideways relative to the flutes, whereby both groups of ducts are substantially disposed in one plane (i.e. in one row) extending parallel with the section base side or section front side.

All constructional features of the sealing section specified within the framework of the claims relate to the unstressed state.

BRIEF DESCRIPTION OF THE DRAWINGS

The invention is now described in the following with the help of exemplified embodiments and by reference to schematic drawings, in which.

Figure 1:
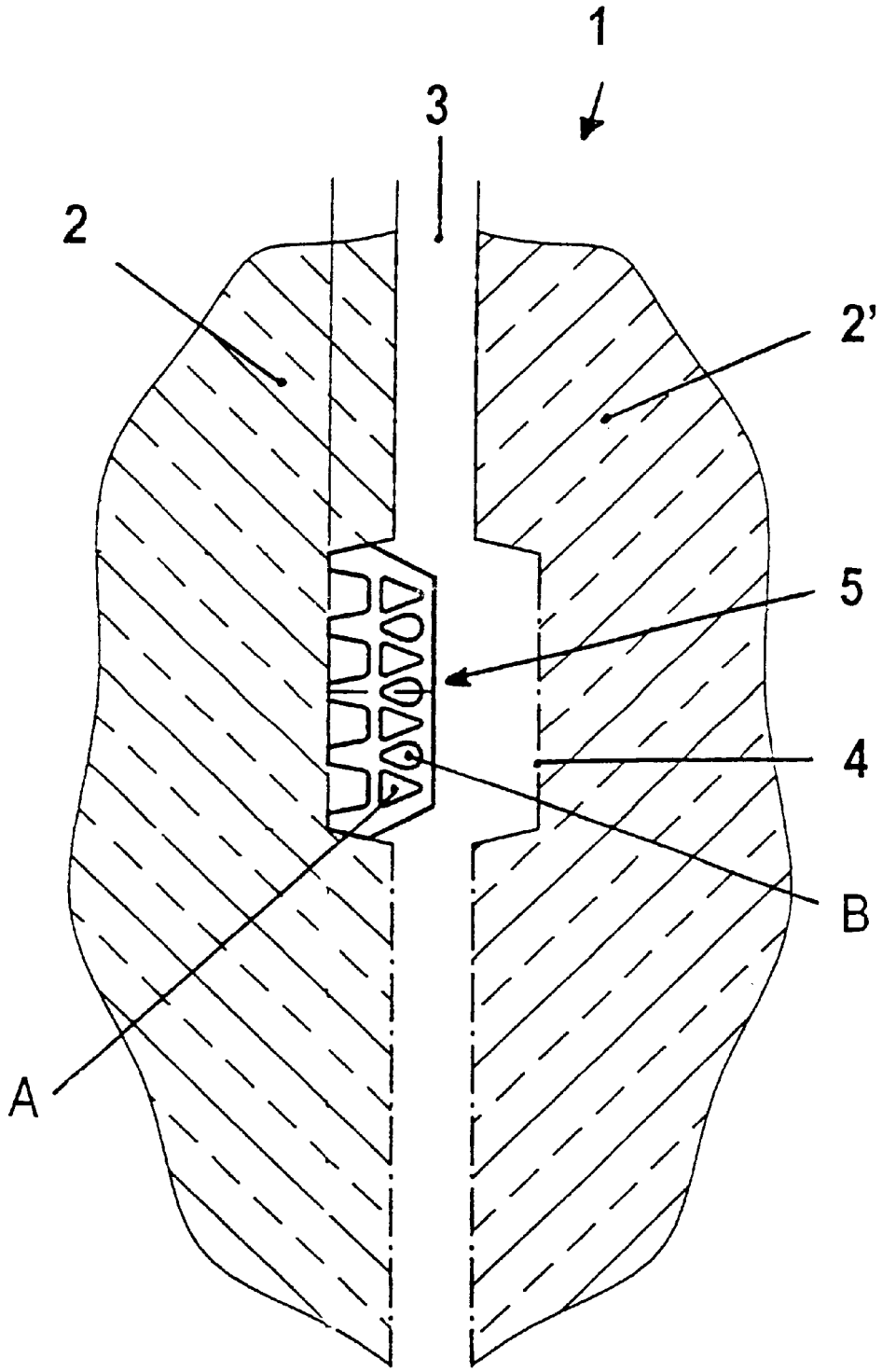
FIG. 1 shows a sealing arrangement comprising two abutting tunnel segments as well as a sealing section located in a recess or groove.

The following list of reference numerals and symbols applies in association with said figures:

| | |
|---|---|
| 1 | Sealing arrangement |
| 2, 2' | Segments of tunnel tubes |
| 3 | Gap (transverse or longitudinal joint) |
| 4 | Recess in the segment |
| 5, 5', 5" | Sealing section made of elastomer material |
| 6, 6', 6" | Flutes with trapezoidal cross section |
| 7, 7', 7" | Ducts of group A |
| 8, 8', 8" | Ducts of group B |
| 9, 9', 9" | Section base side |
| 10, 10', 10" | Section face side |
| 11, 11', 11" | Points of ducts of group A |
| 12, 12', 12" | Base sides of ducts of group A |
| 13, 13', 13" | Points of ducts of group B |
| 14, 14', 14" | Base sides of ducts of group B |
| 15, 15', 15" | Outer wall thickness |
| 16, 16', 16" | Bridges between the ducts |
| 17, 17', 17" | Bridges between the ducts |
| 18, 18', 18" | Bridges between the flutes and ducts |
| X | Plane of the ducts |
| m | Number of ducts (group A) |
| n | Number of ducts (group B). |

DETAILED DESCRIPTION OF THE PREFERRED EMBODIMENT

FIG. 1 shows a sealing arrangement 1 comprising two segments 2, 2'. A gap 3 is located between said two segments and now has to be bridged in a sealing way with the help of sealing section 5. In said arrangement, a sealing section is seated in each recess 4, specifically in connection with the two groups A and B of ducts as defined by the invention.

Figure 2:
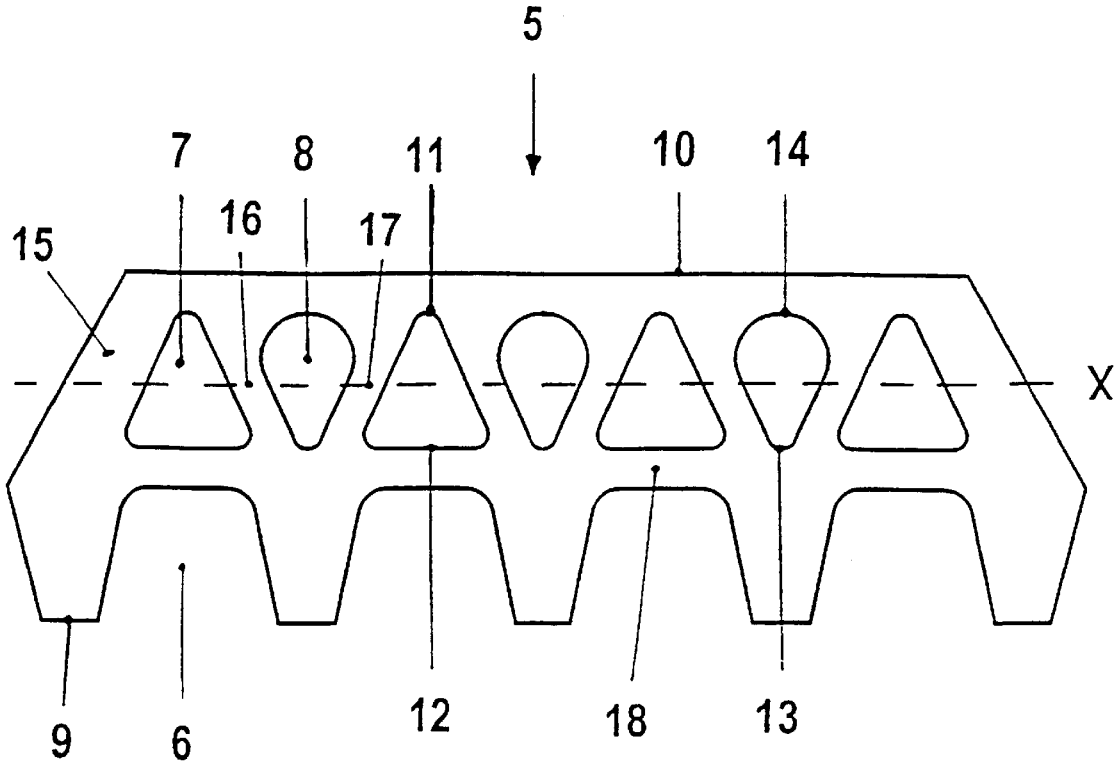
FIG. 2 shows a sealing section with four flutes.

According to FIG. 2, the sealing section 5 has four open flutes 6 which substantially have a trapezoidal cross sectional shape.

Furthermore, the sealing section 5 is provided with a total of seven ducts 7, 8, which are substantially disposed in a plane X, forming the following two groups A and B (FIG. 1):

Group A: This group of four ducts 7 is located directly above the flutes 6. The cross section of said ducts substantially has a triangular shape, whereby the points 11 of said ducts face the section face side 10, whereas their base sides 12 extend substantially parallel with section base side 9 or section face side 10.

Group B: This group of three ducts 8 is offset sideways with respect to the flutes 6. In this case too, the cross section of the ducts substantially has a triangular shape, whereby the points 13 of said ducts, however, point in the direction of section base side 9. The base sides 14 of ducts 8 extend in a curved way.

The further constructional features of sealing section 5 are:

The outer wall thickness 15 is substantially greater than the thickness of the bridges 16, 17 between the ducts 7, 8.

The outer wall thickness 15 is substantially greater than the thickness of the bridge 18, which is located between the flutes 6 and the ducts 7, 8.

The bridges 16, 17 between the ducts 7, 8, as well as the bridge 18 located between the flutes 6 and the ducts 7, 8, have about the same thickness.

Figure 3:
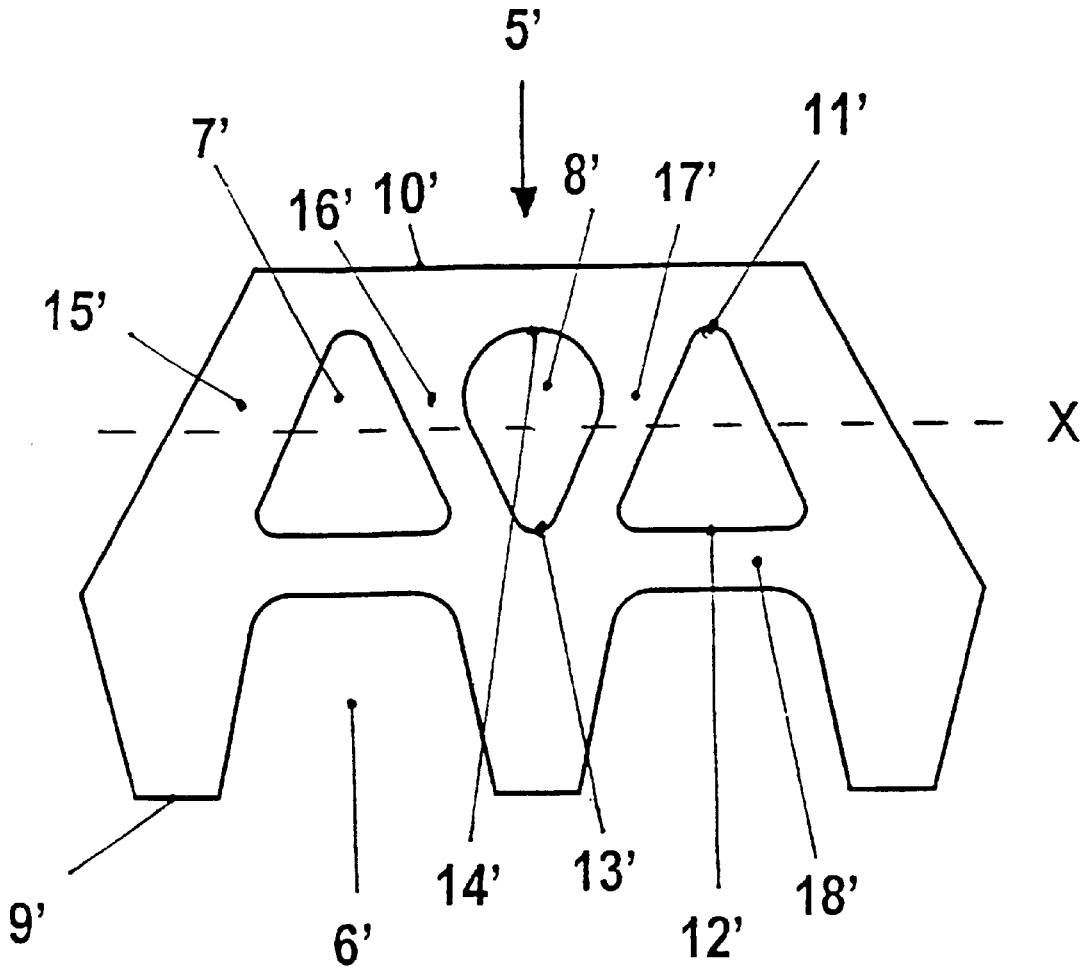
FIG. 3 shows a sealing section with two flutes.
Figure 4:
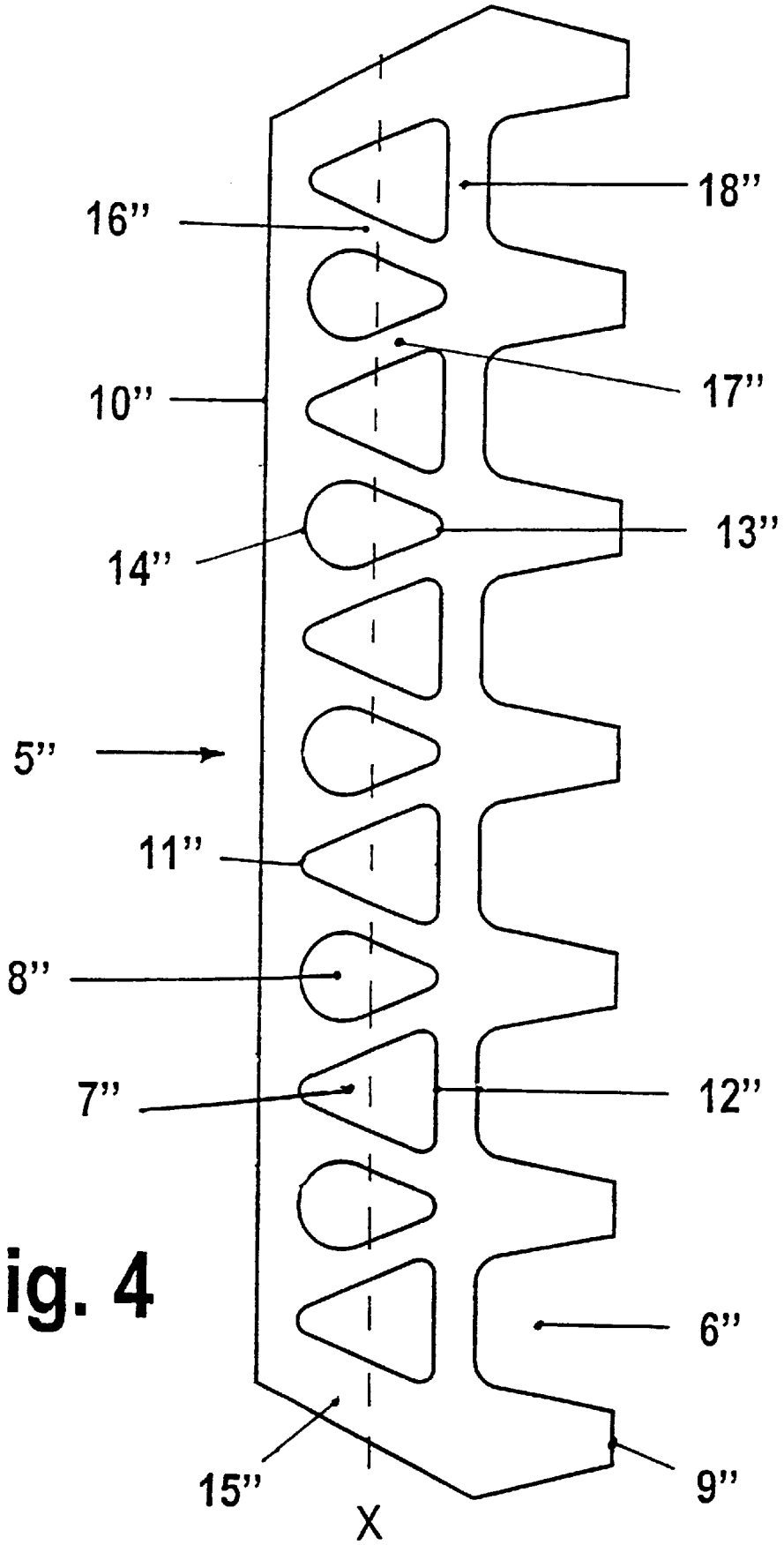
FIG. 4 shows a sealing section with six flutes.

The sealing sections 5', 5" according to FIGS. 3 and 4, respectively, show the same design principle as the sealing section 5 according to FIGS. 1 and 2, in association with a reduced number of two flutes 6' (FIG. 3) and an increased number of six flutes 6" (FIG. 4).

What is claimed is:

1. A sealing arrangement comprising:

two abutting construction elements made of a material selected from the group consisting of concrete, steel, reinforced concrete, and cast iron, said construction elements comprising segments assembled into a tubular tunnel having transverse and longitudinal joints, each segment having at least one recess on its abutting side and extending all around and covering all abutting sides of the segment;

a sealing section made of elastomer material and bridging the gap between two construction elements, said sealing section extending in the form of a strand located in each recess and forming a sealing frame with frame corners, wherein the sealing section is provided with open or closed flutes extending in the form of a strand and arranged on a section base side, and having at least two groups of ducts also extending in the form of strands and arranged between the flutes on a section face side, one group being located directly above the flutes and the other group being laterally offset with respect to the flutes, wherein both groups of ducts are substantially disposed in one plane extending parallel with the section base side or section face side, and wherein the cross-sectional shape of the ducts is substantially triangular with each duct having a point and a base, such that the points of the group of ducts located directly above the flutes face the section face side and the points of the group of ducts arranged laterally offset face the section base side, and wherein the bases of the group of ducts located directly above the flutes extend parallel with the section base side and wherein the triangle bases of the group of ducts arranged offset with respect to the flutes extend in a curved way.

2. The sealing arrangement according to claim 1, characterized in that the number "m" of ducts (7, 7', 7") within the group (A) located directly above the flutes (6, 6', 6") is equal to the number of flutes, whereas the number "n" of ducts (8, 8', 8") within the group (B) arranged laterally offset with respect the flutes (6, 6', 6") is governed by the formula $$n=m-1,$$

whereby "m" is preferably equal to 2 to 6.

3. The sealing arrangement according to claim 1, characterized in that the flutes (6, 6', 6") have a substantially trapezoidal cross sectional shape.

4. The sealing arrangement according to claim 1, characterized in that an outer wall thickness (15, 15', 15") of the sealing sections (5, 5', 5") is substantially greater than the thickness of a bridges (16, 16', 16"; 17, 17', 17") between the ducts (7, 7', 7"; 8, 8', 8") of the two groups (A, B).

5. The sealing arrangement according to claim 1, characterized in that an outer wall thickness (15, 15', 15") of the sealing sections (5, 5', 5") is substantially greater than the thickness of the bridge (18, 18', 18") located between the flutes (6, 6', 6") and the ducts (7, 7', 7"; 8, 8', 8") of the two groups (A, B).

6. The sealing arrangement according to claim 1, characterized in that a bridges (16, 16', 16"; 17, 17', 17") between the ducts (7, 7', 7"; 8, 8', 8") of the two groups (A, B) as well as the bridge (18, 18", 18") located between the flutes (6, 6', 6") and the ducts of the two groups (A, B) have about the same thickness.

* * * * *